US008240800B2

(12) United States Patent
Seto

(10) Patent No.: US 8,240,800 B2
(45) Date of Patent: Aug. 14, 2012

(54) DROPLET EJECTION DEVICE

(75) Inventor: Shinji Seto, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 269 days.

(21) Appl. No.: 12/715,451

(22) Filed: Mar. 2, 2010

(65) Prior Publication Data

US 2011/0043558 A1 Feb. 24, 2011

(30) Foreign Application Priority Data

Aug. 24, 2009 (JP) ..... 2009-193468

(51) Int. Cl.
*B41J 29/38* (2006.01)
*B41J 2/205* (2006.01)
*B41J 2/07* (2006.01)
*B41J 2/17* (2006.01)

(52) U.S. Cl. ..... 347/10; 347/15; 347/74; 347/84

(58) Field of Classification Search ..... None
See application file for complete search history.

(56) References Cited

U.S. PATENT DOCUMENTS

| | | | | |
|---|---|---|---|---|
| 5,285,215 | A | 2/1994 | Liker | |
| 6,488,349 | B1 | 12/2002 | Matsuo et al. | |
| 7,484,836 | B2 * | 2/2009 | Moynihan | 347/84 |
| 2002/0089688 | A1 | 7/2002 | Ferlitsch et al. | |

FOREIGN PATENT DOCUMENTS

| | | |
|---|---|---|
| JP | 7-108568 | 7/1984 |
| JP | 2002-046270 | 2/2002 |
| JP | 2002-211011 | 7/2002 |
| JP | 2002-366324 | 12/2002 |
| JP | 2006-319974 | 11/2006 |

* cited by examiner

*Primary Examiner* — Stephen Meier
*Assistant Examiner* — Alexander C Witkowski
(74) *Attorney, Agent, or Firm* — Fildes & Outland, P.C.

(57) ABSTRACT

There is provided a droplet ejection device including: a droplet ejection unit that successively ejects plural droplets within a pre-specified driving cycle and is capable of causing the plural droplets to aggregate and impact; and a control section that controls application to the droplet ejection unit of driving waveforms among plural driving waveforms that are each capable of ejecting a droplet from the droplet ejection unit, which are generated within the pre-specified driving cycle, such that the driving waveforms that are applied include at least one driving waveform generated at a pre-specified later period in the driving cycle.

2 Claims, 7 Drawing Sheets

DROPLET EJECTION DEVICE

CROSS-REFERENCE TO RELATED APPLICATION

This application claims priority under 35 USC 119 from Japanese Patent Application No. 2009-193468 filed on Aug. 24, 2009.

BACKGROUND

1. Technical Field

The present invention relates to a droplet ejection device.

2. Related Art

Droplet ejection devices of inkjet printers and the like that are provided with a recording head in which nozzles are plurally arrayed, the nozzles ejecting droplets respectively provided by driving elements such as piezoelectric elements or the like, and that eject liquid from the nozzles in accordance with applications of voltages with predetermined driving waveforms to the driving elements are widely gaining in popularity.

For example, technologies have been proposed, in which plural droplets are successively ejected with varying ejection speeds within a pre-specified driving cycle, and the ejected droplets are aggregated and caused to impact on a recording medium.

SUMMARY

An aspect of the present invention provides a droplet ejection device including:

a droplet ejection unit that successively ejects plural droplets within a pre-specified driving cycle and is capable of causing the plurality of droplets to aggregate and impact; and a control section that controls application to the droplet ejection unit of driving waveforms among plural driving waveforms that are each capable of ejecting a droplet from the droplet ejection unit, which are generated within the pre-specified driving cycle, such that the driving waveforms that are applied include at least one driving waveform generated at a pre-specified later period in the driving cycle.

BRIEF DESCRIPTION OF THE DRAWINGS

Exemplary embodiments of the present invention will be described in detail based on the following figures, wherein.

DETAILED DESCRIPTION

Herebelow, an example of an exemplary embodiment of the present invention is described in detail with reference to the attached drawings. In the present exemplary embodiment, the present invention is applied to an image forming device.

Figure 1:
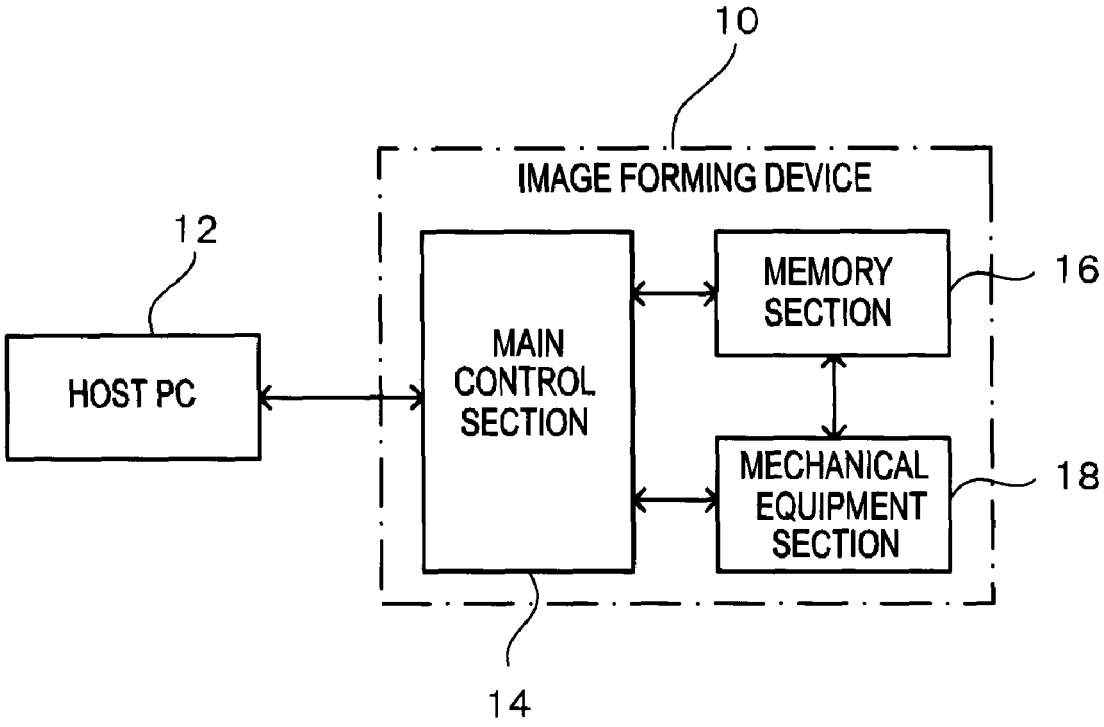
FIG. 1 is a diagram illustrating general structure of an image forming device relating to an exemplary embodiment of the present invention.

FIG. 1 is a diagram illustrating general structure of the image forming device relating to the exemplary embodiment of the present invention.

An image forming device 10 relating to the exemplary embodiment of the present invention is connected to a host computer (PC) 12, and transfers image forming instructions and image information from the host PC 12.

The image forming device 10 is provided with a main control section 14, a recording section 16 and a mechanical equipment section 18. In response to image forming instructions and image information outputted from the host PC 12, the image forming device 10 image-forms images based on the image information on recording paper or the like.

The recording section 16 is provided to correspond with, for example, each of the four colors YMCK, and is structured by heads that respectively eject ink drop. Each head includes plural nozzles from which ink drops are ejected by driving of driving elements, which are piezoelectric elements or the like. The present exemplary embodiment is described with piezoelectric elements serving as the driving elements and ejecting the ink drops. However, a thermal system in which ink drops are ejected using heating elements may also be employed.

The mechanical equipment section 18 is structured to include a conveyance mechanism that conveys a recording medium to a position at which image formation is possible, an ejection mechanism that ejects from the image formation position a recording medium on which image formation has been completed, and so forth.

Ink droplet ejection operations at the recording section 16 and recording medium conveyance operations at the mechanical equipment section 18 are controlled by the main control section 14.

Figure 2:
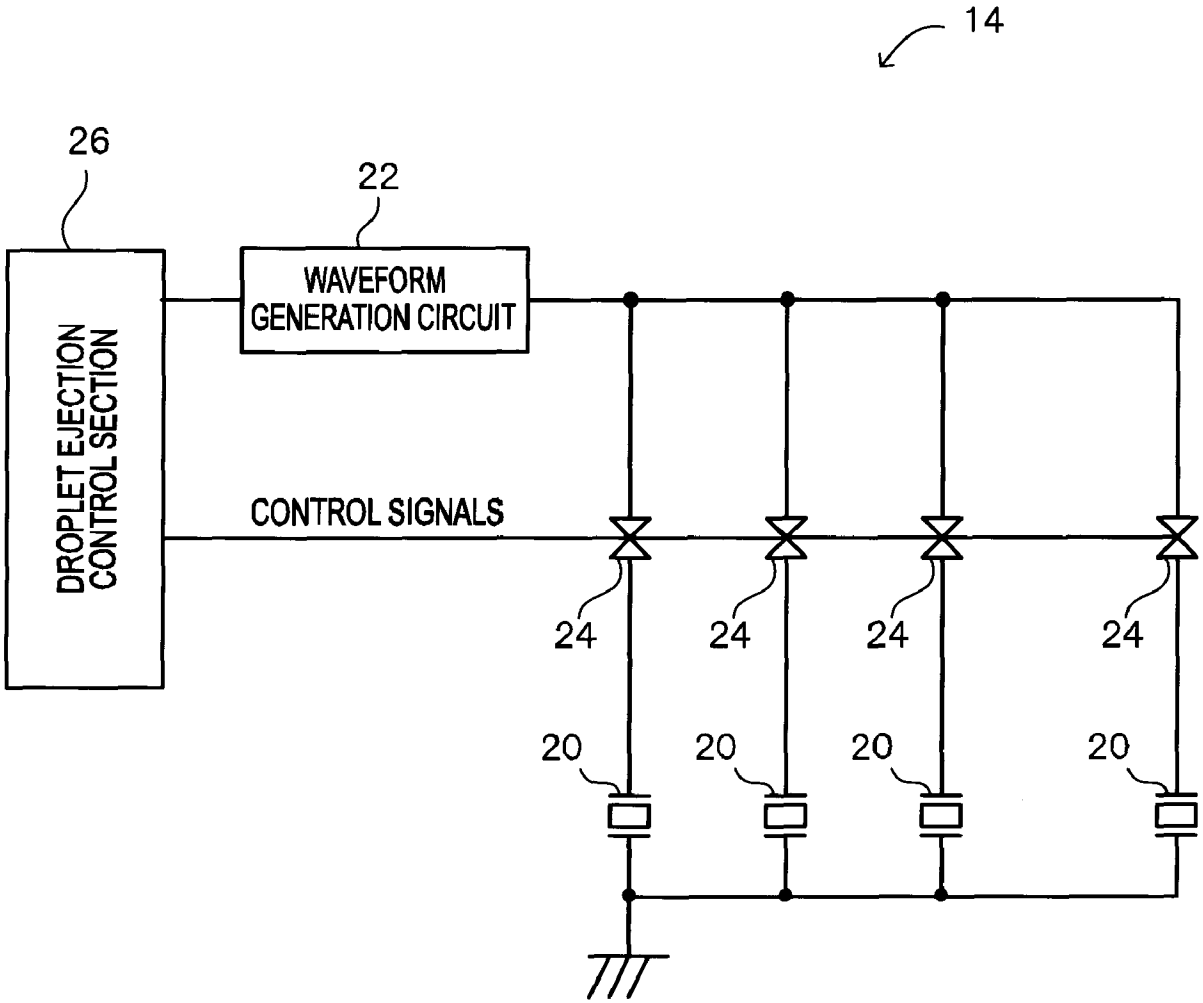
FIG. 2 is a diagram illustrating structure of a principal control section of the image forming device relating to the exemplary embodiment of the present invention.

FIG. 2 is a diagram illustrating structure of the main control section 14 of the image forming device 10 relating to the exemplary embodiment of the present invention.

The main control section 14 is structured to include a waveform generation circuit 22, switching elements 24 and a droplet ejection control section 26. The waveform generation circuit 22 generates driving waveforms which are supplied to driving elements 20 that are provided in correspondence with respective nozzles. The switching elements 24 switch the waveforms that are to be supplied to the driving elements 20 provided in correspondence with the respective nozzles. The droplet ejection control section 26 exchanges signals with the switching elements 24 and suchlike, and controls the same. Note that signals that are received from the mechanical equipment section 18 or the like for starting ejection operations and signal lines from various sensors and suchlike are not illustrated in FIG. 2.

The waveform generation circuit 22 generates a plural number of driving waveforms within a pre-specified driving cycle that is needed to eject ink droplets corresponding to one pixel. The plural driving waveforms generated in the driving cycle are specified such that later driving waveforms have faster droplet speeds of the droplets.

The droplet ejection control section 26 outputs control signals and controls the switching elements 24 to turn on and off in time divisions. Thus, the droplet ejection control section 26 selects which driving waveforms of the plural driving waveforms generated in the driving cycle are applied to the driving elements 20. Here, the droplet ejection control section 26 inputs control signals to the switching elements 24 respectively individually.

That is, by numbers of driving waveforms that are applied to the driving elements 20, among the plural driving waveforms generated by the waveform generation circuit 22, being varied in driving cycles, numbers of ink droplets that are ejected are altered, the sizes of ink drops that are ejected onto a recording paper are controlled, and gradations are manifested.

Specifically, in the present exemplary embodiment, the waveform generation circuit 22 generates driving waveforms in rectangular pulses. For the plural rectangular pulses that are generated, voltages and application timings are specified beforehand, such that the driving waveforms eject ink droplets with faster droplet speeds in correspondence with the passage of time in the driving cycle.

When a small drop is to be ejected, a small ink droplet is ejected by controlling a switching element 24 so as to apply to the driving element 20, of the plural driving waveforms that the waveform generation circuit 22 generates, a single driving waveform that is generated at a pre-specified later period of the driving cycle.

When a medium drop is to be ejected, two successive ink droplets are ejected by controlling the switching element 24 so as to successively apply to the driving element 20, of the plural driving waveforms that the waveform generation circuit 22 generates, a driving waveform that is generated at a timing earlier than the driving waveform that is used for small drops, and then the driving waveform that is used for small drops. Thus, two ink droplets are successively ejected and are caused to aggregate and impact on the recording paper.

When a large drop is to be ejected, three successive ink droplets are ejected by controlling the switching element 24 so as to successively apply to the driving element 20, of the plural driving waveforms that the waveform generation circuit 22 generates, a driving waveform that is generated at a timing earlier than the driving waveforms that are used for medium drops, and then the driving waveforms (two driving waveforms) that are used for medium drops. Thus, three ink droplets are successively ejected and are caused to aggregate and impact on the recording paper.

Figure 3:
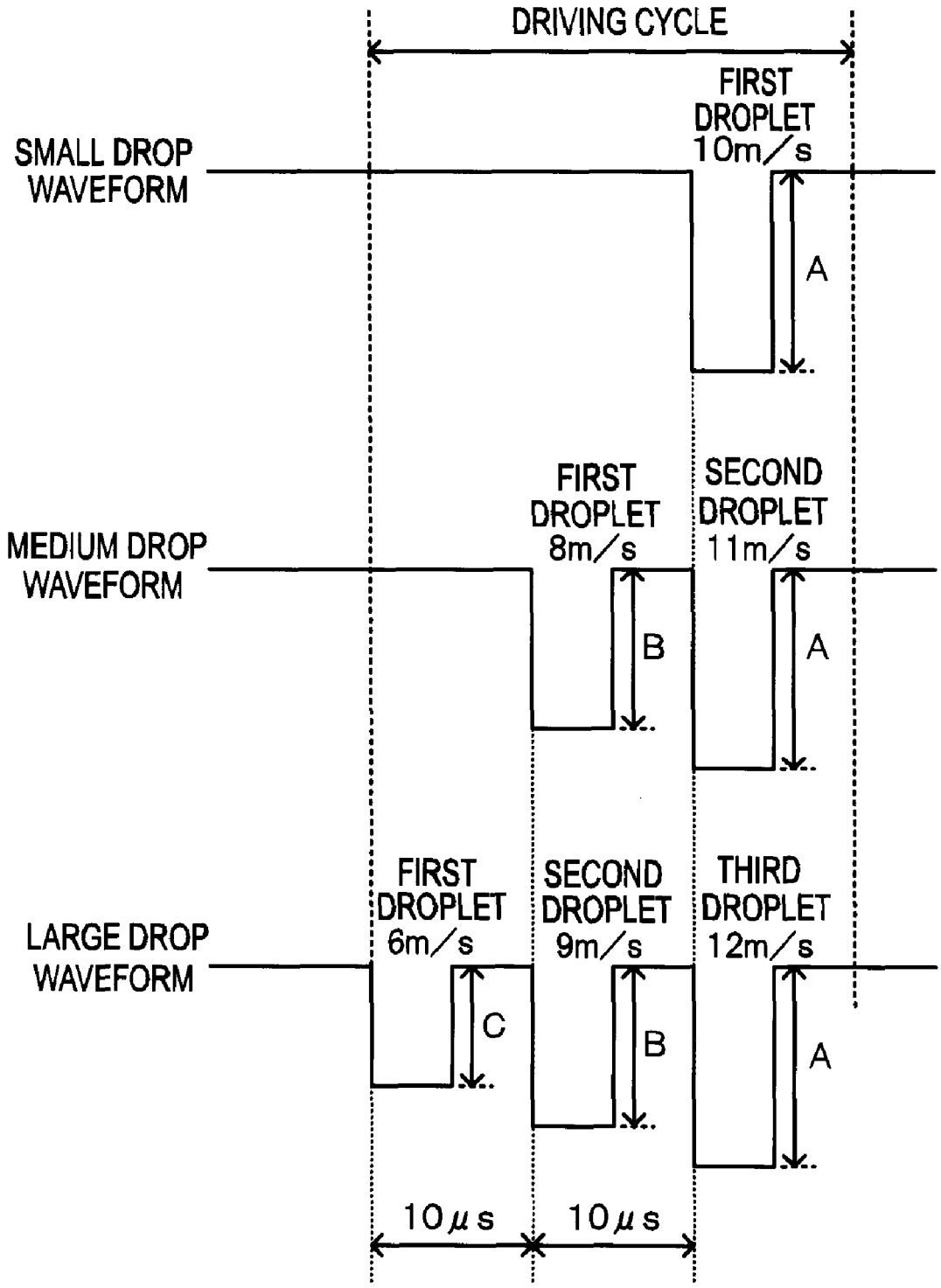
FIG. 3 is a diagram illustrating examples of driving waveforms for ejecting small drops, medium drops and large drops.

Now, the driving waveforms for ejecting small drops, medium drops and large drops will be described with specific examples. FIG. 3 is a diagram illustrating examples of the driving waveforms for ejecting small drops, medium drops and large drops.

As illustrated in FIG. 3, the driving waveform for ejecting a small drop (the small drop waveform) employs a driving waveform with a voltage of amplitude A from 20 μs after the start of the pre-specified driving cycle. In the present exemplary embodiment, a driving waveform in which the amplitude A is specified such that the droplet speed is 10 m/s is employed.

Further, as illustrated in FIG. 3, the driving waveform for ejecting a medium drop (the medium drop waveform) employs a driving waveform constituted by a driving waveform with a voltage of amplitude B (A>B) from 10 μs after the start of the pre-specified driving cycle and then the driving waveform with the voltage of amplitude A from 20 μs after the start of the pre-specified driving cycle. In the present exemplary embodiment, the driving waveform that is employed is constituted by a driving waveform in which the amplitude B is specified such that the first droplet speed is 8 m/s and the driving waveform in which the amplitude A is specified such that the second droplet speed 10 μs later is 10 m/s. When these driving waveforms are applied to the driving element 20 and the ink droplets are ejected, the second ejection has a droplet speed at 11 m/s, because of reverberation from the first ejection.

Further again, as illustrated in FIG. 3, the driving waveform for ejecting a large drop (the large drop waveform) employs a driving waveform constituted by a driving waveform with a voltage of amplitude C (B>C) at the start of the pre-specified driving cycle, the driving waveform with the voltage of amplitude B (A>B) from 10 μs after the start of the pre-specified driving cycle, and the driving waveform with the voltage of amplitude A from 20 μs after the start of the pre-specified driving cycle. In the present exemplary embodiment, the driving waveform that is employed is constituted by a driving waveform in which the amplitude C is specified such that the first droplet speed is 6 m/s, the driving waveform in which the amplitude B is specified such that the second droplet speed 10 μs later is 8 m/s, and the driving waveform in which the amplitude A is specified such that the third droplet speed 10 μs thereafter is 10 m/s. When these driving waveforms are applied to the driving element 20 and the ink droplets are ejected, the second ejection has a droplet speed at 11 m/s, because of reverberation from the first ejection, and the third ejection has a droplet speed at 12 m/s, because of reverberation from the first and second ejections.

The driving waveform for a small drop and the second driving waveform for a medium drop have the same timing in the driving cycle as the third driving waveform for a large drop, and the first driving waveform for a medium drop has the same timing in the driving cycle as the second driving waveform for a large drop. That is, in the example in FIG. 3, the driving waveform for a small drop and the second driving waveform for a medium drop are applied from 20 μs after the timing of application in the driving cycle of the first driving waveform for a large drop, and the first driving waveform for a medium drop is applied from 10 μs after the timing of application in the driving cycle of the first driving waveform for a large drop. In other words, the driving waveforms include a driving waveform at a pre-specified later period (the last) of each driving cycle.

Next, for the image forming device relating to the exemplary embodiment of the present invention structured as described hereabove, flying distances and impact timings when each of small drops, medium drops and large drops are ejected using the driving waveforms described hereabove will be described.

Firstly, a flying distance when a small drop is ejected is described. When a small drop is to be ejected, the switching element 24 is turned on at a time from 20 μs after the start of the driving cycle (after the timing in the driving cycle at which the first droplet of a large drop is ejected), and the switching element 24 is turned off at the end of the driving cycle. Thus, the driving waveform with the voltage of amplitude A is applied to the driving element 20. As a result, one ink droplet is ejected, with a droplet speed of 10 m/s, from 20 μs after the start of the driving cycle.

The ink droplet that is ejected thus will have flown around 1 mm at 120 μs from the start of the driving cycle.

Figure 4A:
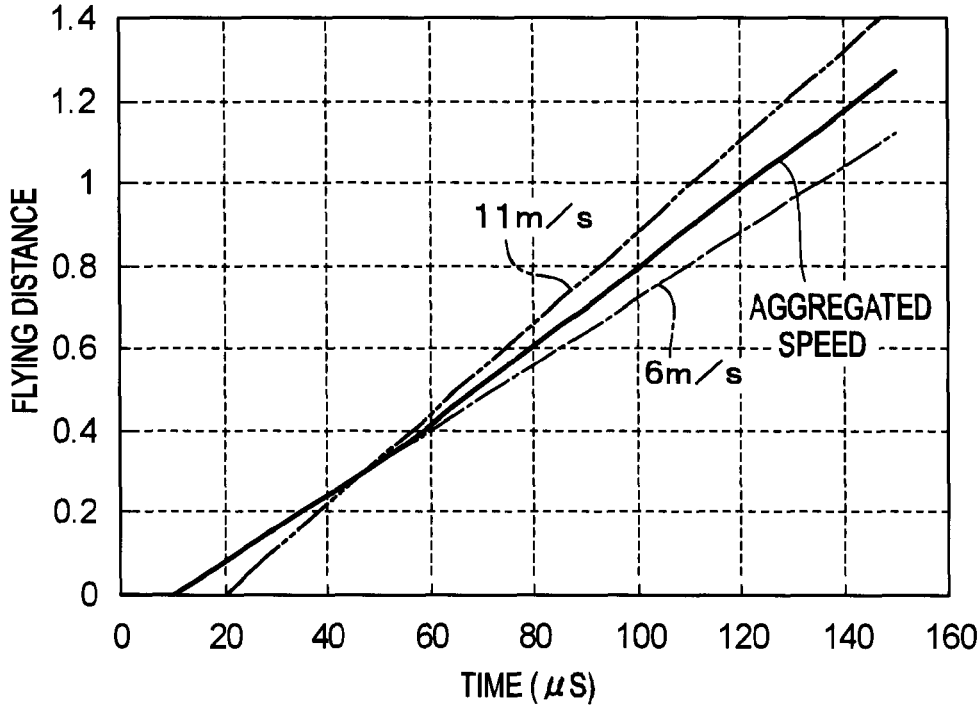
FIG. 4A is a graph showing time against flying distance when the medium drop waveform of FIG. 3 is applied to a driving element.

Next, the flying distance when a medium drop is ejected is described. FIG. 4A is a graph showing time against flying distance when the medium drop waveform of FIG. 3 is applied to a driving element.

The switching element 24 is turned on at a time from 10 μs after the start of the driving cycle (after the timing in the driving cycle at which the first droplet of a large drop is ejected), and the switching element 24 is turned off at the end of the driving cycle. Thus, the driving waveform with the voltage of amplitude B is applied to the driving element, and the first ink droplet is ejected, with a droplet speed of 8 m/s. From 10 μs thereafter, the driving waveform with the voltage of amplitude A is applied to the driving element 20, and the second ink droplet is ejected. Although the second ink droplet here is set with a voltage that gives a droplet speed of 10 m/s when a single droplet is ejected, the second ink droplet is ejected at a speed of 11 m/s because of reverberation from the first ejection.

As illustrated in FIG. 4A, the two flying droplets that are ejected thus aggregate at around 60 μs. Hence, given a droplet speed calculated by the principle of conservation of momentum, the aggregated ink droplet will have flown around 1 mm after 120 μs.

Figure 4B:
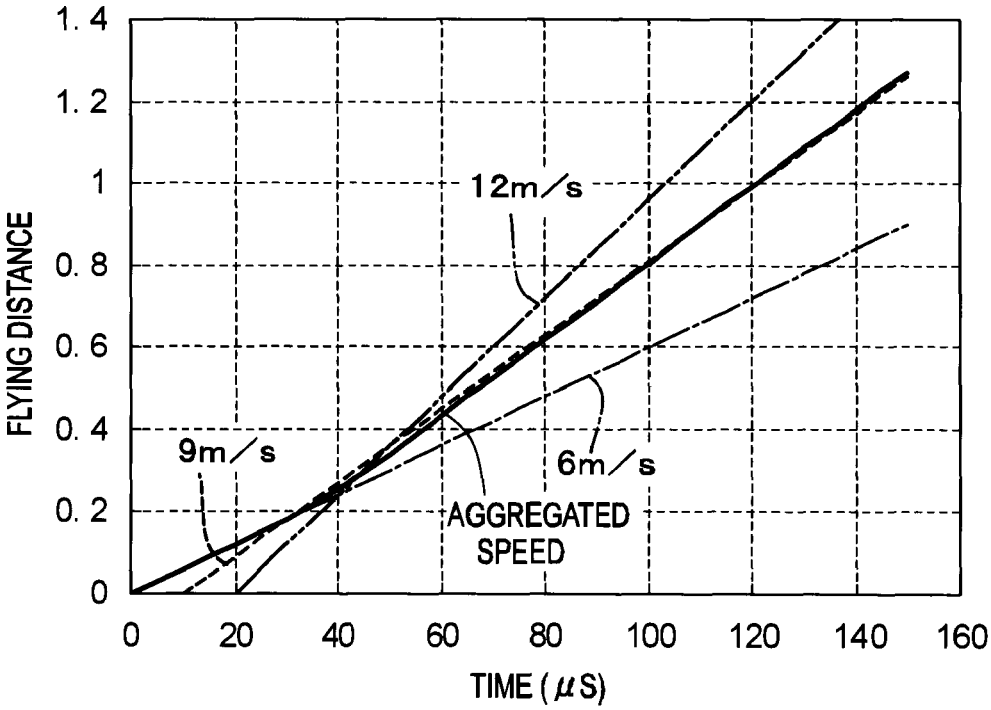
FIG. 4B is a graph showing time against flying distance when the large drop waveform of FIG. 3 is applied to a driving element.

Next, the flying distance when a large drop is ejected is described. FIG. 4B is a graph showing time against flying distance when the large drop waveform of FIG. 3 is applied to the driving element 20.

First, the switching element 24 is turned on at the start of the driving cycle, and the switching element 24 is turned off at the end of the driving cycle. Thus, the driving waveform with the voltage of amplitude C is applied to the driving element 20 at the start of the driving cycle, and the first ink droplet is ejected, with a droplet speed of 6 m/s. From 10 μs thereafter, the driving waveform with the voltage of amplitude B is applied to the driving element 20, and the second ink droplet is ejected. Although the second ink droplet here is set with a voltage that gives a droplet speed of 8 m/s when a single droplet is ejected, the second ink droplet is ejected at a speed of 9 m/s because of reverberation from the first ejection. Then, 10 μs thereafter, the driving waveform with the voltage of amplitude A is applied to the driving element 20, and the third ink droplet is ejected. Although the third ink droplet here is set with a voltage that gives a droplet speed of 10 m/s when a single droplet is ejected, the third ink droplet is ejected at a speed of 12 m/s because of reverberation from the first and second ejections.

As illustrated in FIG. 4B, the three flying droplets that are ejected thus aggregate at around 60 μs. Hence, given a droplet speed calculated by the principle of conservation of momentum, the aggregated ink droplet will have flown around 1 mm after 120 μs.

Times and flying distances of each of the small drop (single shot), medium drop (double shot) and large drop (triple shot) that are ejected as described above in this case are illustrated in FIG. 5.

Figure 5:
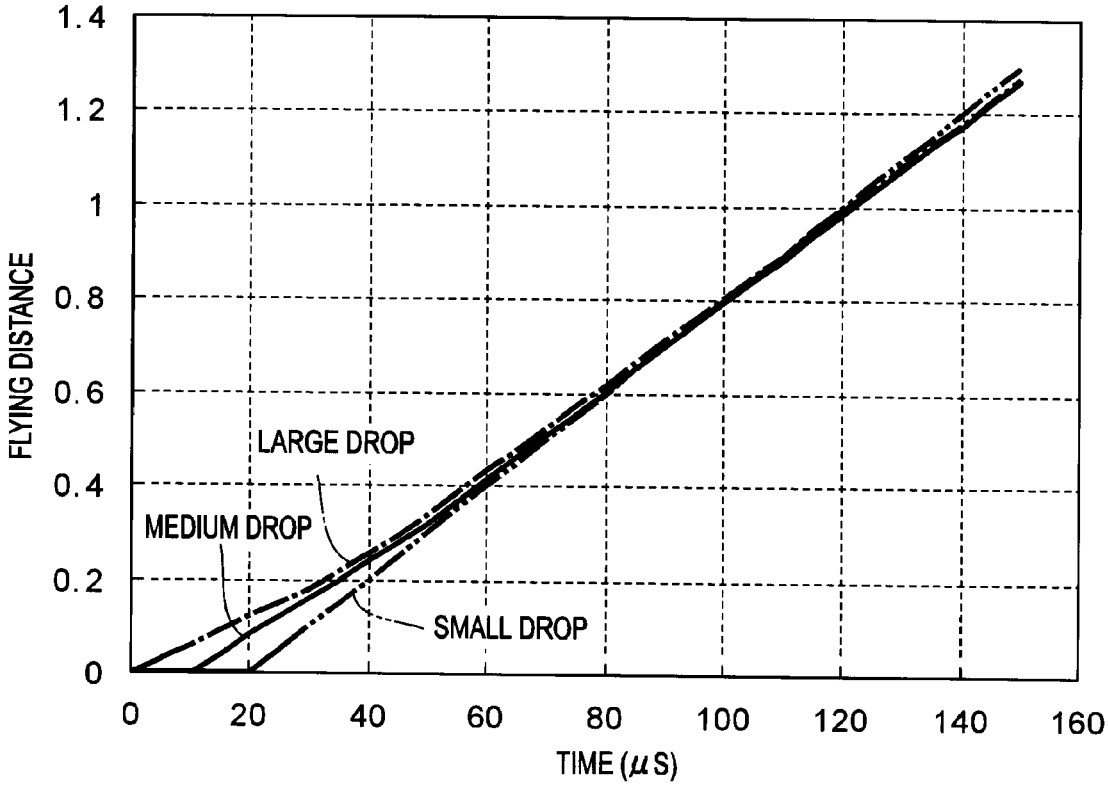
FIG. 5 is a graph illustrating time against flying distance for each of small drops, medium drops and large drops.

As can be seen from FIG. 5, the ink droplets of the respective sizes small, medium and large are at flying distances of around 1 mm after 120 μs from the start of the respective driving cycles. Therefore, variations in impact timings may be suppressed by setting the recording paper at a position approximately 1 mm away.

Thus, impact timing variations are suppressed by performing control such that driving waveforms that are applied to the driving element 20 include, of a plural number of driving waveforms that are each capable of ejecting a droplet which are generated in a pre-specified driving cycle, at least one driving waveform generated at a pre-specified later period in the driving cycle (in the present exemplary embodiment, the last of the plural driving waveforms generated within the driving cycle).

Figure 6A:
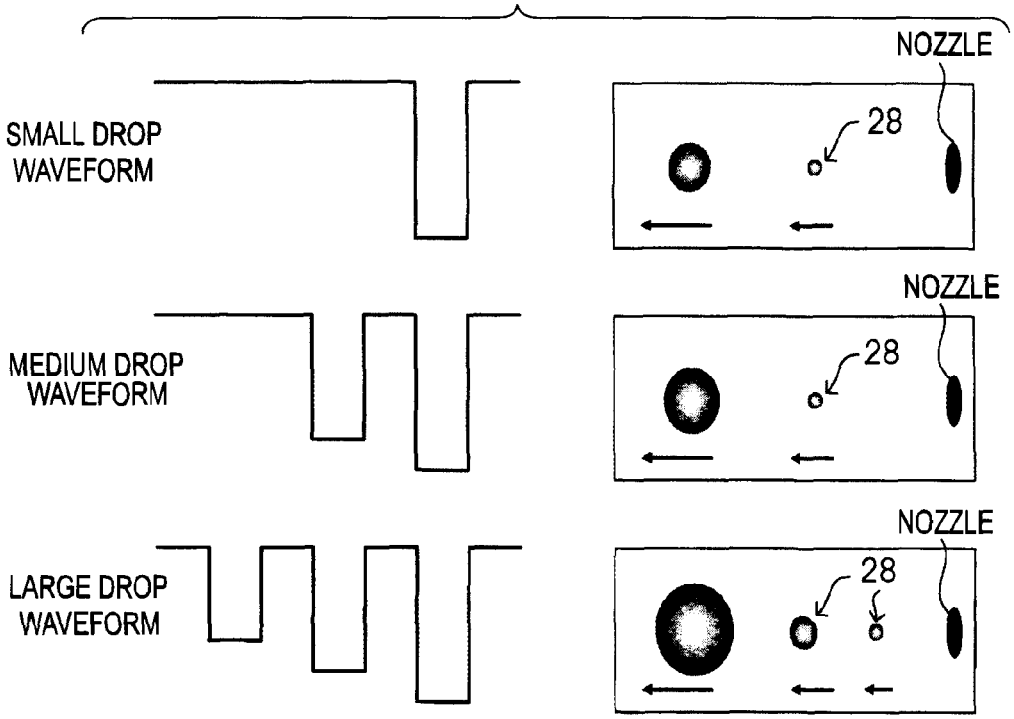
FIG. 6A is diagrams for describing satellites that are caused by reverberation.

Now, in the exemplary embodiment described hereabove, after ejection of the ink droplet of each size, a satellite 28 may be produced by reverberation, as illustrated in FIG. 6A.

Figure 6B:
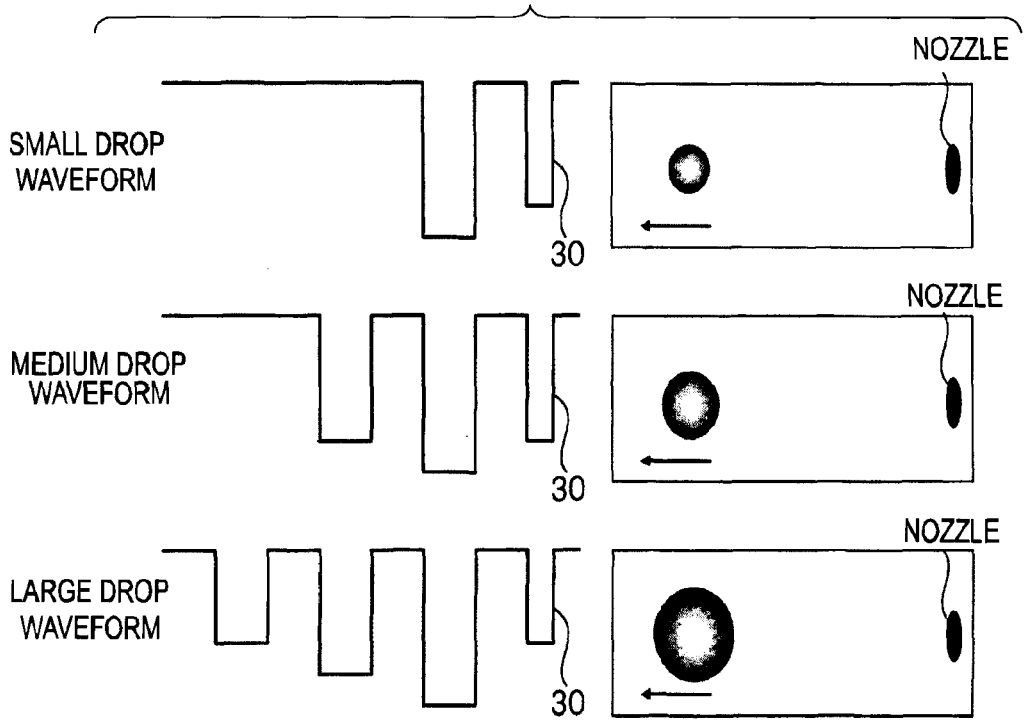
FIG. 6B is diagrams for describing prevention of the satellites.

Accordingly, as illustrated in FIG. 6B, waveforms with dimensions such that ink droplets are not ejected at the end (satellite prevention waveforms 30) are applied at the end of the driving waveforms that eject the respective drops. Thus, the satellites 28 illustrated in FIG. 6A that are produced by reverberation are prevented.

In a period in which image formation is not being performed, the satellite prevention waveforms 30 may be applied to the driving element 20 and utilized as ink viscosity prevention waveforms.

Figure 7:
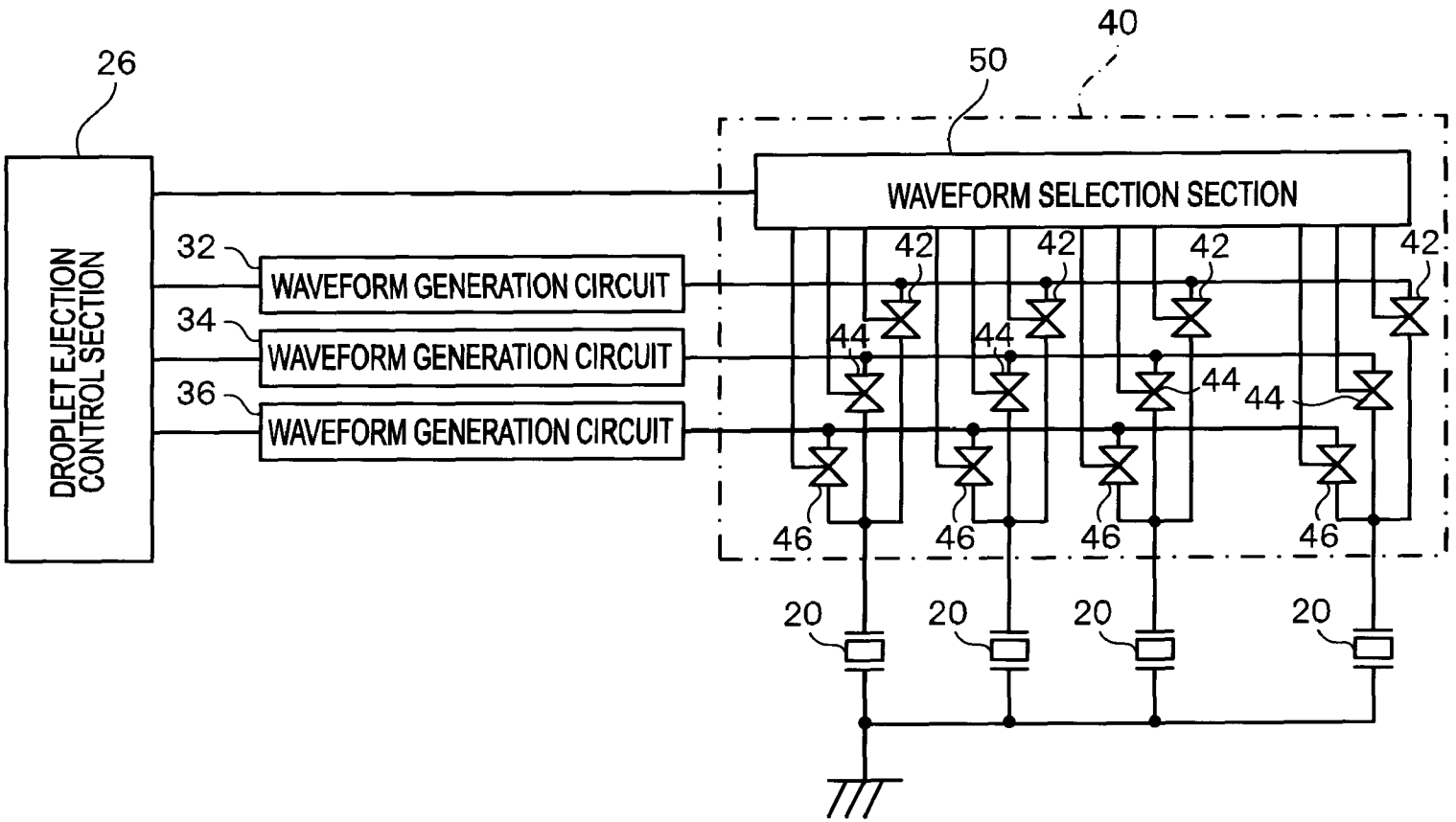
FIG. 7 is a diagram illustrating structure of a principal control section in a variant example of the image forming device relating to the exemplary embodiment of the present invention.

Now, a variant example of the image forming device relating to the exemplary embodiment of the present invention will be described. FIG. 7 is a diagram illustrating structure of a principal control section 50 in the variant example of the image forming device relating to the exemplary embodiment of the present invention. Structures that are the same as in the exemplary embodiment described hereabove are described with the same reference numerals assigned.

In the exemplary embodiment described above, the waveform generation circuit 22 generates the plural driving waveforms within the pre-specified driving cycle, performs time division control of the switching elements 24, and selects the driving waveforms to be applied to the driving elements 20. In the variant example however, three waveform generation circuits are provided: a waveform generation circuit 32 that generates a driving waveform for small drop ejection, a waveform generation circuit 34 that generates a driving waveform for medium drop ejection, and a waveform generation circuit 36 that generates a driving waveform for large drop ejection. Other structures are the same, so only differences will be described.

The principal control section 50 of the variant example is structured to include the waveform generation circuits 32 to 36, a switching section 40, and the droplet ejection control section 26. The waveform generation circuits 32 to 36 generate the driving waveforms to be supplied to the driving elements 20 provided in correspondence with the nozzles. The switching section 40 switches the driving waveforms to be supplied to the driving elements 20 provided in correspondence with the nozzles. The droplet ejection control section 26 exchanges signals with the waveform generation circuits 32 to 36, the switching section 40 and suchlike, and controls the same. Note that signals that are received from the mechanical equipment section 18 or the like for starting ejection operations and signal lines from various sensors and suchlike are not illustrated in FIG. 7.

In the variant example, the three waveform generation circuits—the waveform generation circuit 32 that generates the driving waveform for small drop ejection, the waveform generation circuit 34 that generates the driving waveform for medium drop ejection, and the waveform generation circuit 36 that generates the driving waveform for large drop ejection—are provided. For the variant example too, a case in which ink drops in three size categories (the three categories of small drops, medium drops and large drops) is described as an example.

The waveform generation circuit 32 (small drop waveform) generates a single rectangular pulse driving waveform in the pre-specified driving cycle that is needed to eject ink droplets corresponding to one pixel. The waveform generation circuit 34 (medium drop waveform) generates two successive rectangular pulse driving waveforms in the driving cycle, and the waveform generation circuit 36 (large drop waveform) generates three successive rectangular pulse driving waveforms in the driving cycle.

The switching section 40 selectively supplies the driving waveforms generated by the waveform generation circuits 32 to 36 to the driving elements 20 corresponding to the nozzles. More specifically, the switching section 40 is provided with switching elements 42, 44 and 46, which are connected to the waveform generation circuits 32, 34 and 36, respectively. In accordance with instructions from the droplet ejection control section 26, the switching section 40 selects a driving waveform (waveform set) to be applied to a driving element 20 by the principal control section 50 turning the switching elements 42 to 46 on and off.

That is, by the driving waveform (waveform sets) generated by any of the waveform generation circuits 32 to 36 being applied to the driving element 20, the three categories of ink drop, small drops, medium drops and large drops, are ejected and gradations are manifested.

Specifically, the waveform generation circuit 32 that generates the driving waveform that ejects small drops generates a single rectangular pulse driving waveform in a pre-specified later period of the driving cycle, and a small ink droplet is ejected by applying this driving waveform to a driving element 20.

The waveform generation circuit 34 that generates the driving waveform that ejects medium drops generates two successive rectangular pulse driving waveforms, and two successive ink droplets are ejected by successively applying the two rectangular pulses to the driving element 20. Here, the second rectangular pulse is generated in the pre-specified later period of the driving cycle (with the same timing as the rectangular pulse for a small drop). Furthermore, application voltages and application timings are regulated to make the ejection speed of the second droplet faster than that of the first, and the two ink droplets are caused to aggregate and impact on the recording medium.

The waveform generation circuit 36 that generates the driving waveform that ejects large drops generates three successive rectangular pulse driving waveforms, and three successive ink droplets are ejected by successively applying the three rectangular pulses to the driving element 20. Here, the third rectangular pulse is generated in the pre-specified later period of the driving cycle (with the same timing as the rectangular pulse for a small drop and the second rectangular pulse for a medium drop), and the second rectangular pulse is generated with the same timing as the first rectangular pulse for a medium drop. Furthermore, application voltages and application timings are regulated to make the ejection speeds faster in the order first, second, third, and the three ink droplets are caused to aggregate and impact on the recording medium.

That is, the waveform generation circuit 32 generates the small drop waveform illustrated in FIG. 3 in each driving cycle, the waveform generation circuit 34 generates the medium drop waveform illustrated in FIG. 3 in each driving cycle and the waveform generation circuit 36 generates the large drop waveform illustrated in FIG. 3 in each driving cycle, and the switching section 40 operates similarly to the exemplary embodiment described earlier by selecting the waveform generation circuits 32 to 36 to be applied to the driving elements 20.

Anyway, in the exemplary embodiment and variant example described hereabove, in specifying the droplet speeds, the amplitudes of the pulse waveforms are set so as to specify the droplet speeds. However, pulse widths may be altered to alter the droplet speeds, or both amplitudes and pulse widths may be altered to set the droplet speeds.

Furthermore, in the exemplary embodiment and variant example described hereabove, when a medium drop is to be ejected, the last and second driving waveforms of the driving cycle are employed. However, this is not to be limiting. For example, the last and first driving waveforms may be employed. In this case, droplet speed settings, which is to say amplitude values of the pulses that are applied, need to be altered such that the impact timings match up.

In the exemplary embodiment described hereabove, a case of ejecting droplets in three size categories has been taken as an example and described. However, this is not to be limiting: there may be two categories, and there may be four or more categories.

In the exemplary embodiment described hereabove, an image forming device has been taken as an example and described. However the droplet injection device is not to be limited thus. For example, application is possible to common droplet ejection devices that are targeted at various industrial applications, such as ejecting colored inks onto polymer films to fabricate color filters for displays, ejecting organic electroluminescent solutions onto substrates to form electroluminescent display panels, and so forth.

What is claimed is:

1. A droplet ejection device comprising:

a droplet ejection unit that successively ejects a plurality of droplets within a pre-specified driving cycle and is capable of causing the plurality of droplets to aggregate and impact; and a control section that controls application to the droplet ejection unit of driving waveforms among a plurality of driving waveforms that are each capable of ejecting a droplet from the droplet ejection unit, which are generated within the pre-specified driving cycle, such that the driving waveforms that are applied include at least one driving waveforms generated at a pre-specified later period in the driving cycle, wherein voltages and application times of the plurality of driving waveforms are specified in advance such that droplet speeds of droplets that are ejected later are faster and flying distances of the droplets after a pre-specified duration are at a pre-specified distance.

2. The droplet ejection device according to claim 1, wherein the control section performs further control, after the last driving waveform capable of ejecting a droplet in the driving cycle, so as to apply a single waveform that does not eject a droplet in the driving cycle.

* * * * *